US005982298A

United States Patent [19]

Lappenbusch et al.

[11] Patent Number: 5,982,298

[45] Date of Patent: Nov. 9, 1999

[54] INTERACTIVE TRAFFIC DISPLAY AND TRIP PLANNER

[75] Inventors: Richard W. Lappenbusch, Seattle, Wash.; Eric T. Bauer, Palo Alto, Calif.; Charles H. Shoemaker, Redmond, Wash.

[73] Assignee: Microsoft Corporation, Redmond, Wash.

[21] Appl. No.: 08/748,993

[22] Filed: Nov. 14, 1996

[51] Int. Cl.[6] ..... G08G 1/09

[52] U.S. Cl. ..... 340/905; 340/995; 348/149; 701/117; 701/208

[58] Field of Search ..... 340/990, 995, 340/905; 701/117, 200, 201, 208, 211; 395/200.48; 348/148, 149

[56] References Cited

U.S. PATENT DOCUMENTS

| | | | |
|---|---|---|---|
| 4,792,803 | 12/1988 | Madnick et al. | 340/905 |
| 4,812,843 | 3/1989 | Champion, III et al. | 340/989 |
| 5,173,691 | 12/1992 | Sumner | 340/905 |
| 5,257,023 | 10/1993 | Furuya | 340/905 |
| 5,317,311 | 5/1994 | Martell et al. | 340/905 |
| 5,396,429 | 3/1995 | Hanchett | 340/910 |
| 5,523,950 | 6/1996 | Peterson | 340/905 |
| 5,635,953 | 6/1997 | Hayami et al. | 340/990 |
| 5,654,886 | 8/1997 | Zereski, Jr. et al. | 395/200.48 |
| 5,732,383 | 3/1998 | Foladare et al. | 701/117 |

*Primary Examiner*—Brent A. Swarthout
*Attorney, Agent, or Firm*—Lee & Hayes, PLLC

[57] ABSTRACT

The invention includes a traffic information system having servers that makes traffic data, images and video clips available to client devices in a common format that is independent of the format used within any particular public highway monitoring system that supplies the raw media elements. The invention further includes a user interface for depiction on a graphical display surface. The user interface has a road map showing a plurality of road segments that a user can interactively select. In addition, the user interface has a road image area that changes as the user selects different road segments to show recent images of a currently selected road segment. The images are obtained from public highway monitoring systems. Both a broad view and a detail view are available. In the broad view, highways are broken into high level segments and corresponding data such as average speed or travel time is shown only for the high level segments. In the detail view, a segment is shown broken into smaller sub-segments, and the user can view data at the level of the sub-segments. In addition to displaying traffic data and images, the user interface allows a user to find a shortest-time route between designated locations.

34 Claims, 8 Drawing Sheets

INTERACTIVE TRAFFIC DISPLAY AND TRIP PLANNER

TECHNICAL FIELD

This invention relates to public highway monitoring systems and to systems that display the data and information available from such monitoring systems.

BACKGROUND OF THE INVENTION

Several states have implemented systems for monitoring conditions on potentially congested public highways. Such systems typically incorporate sensors or speed traps installed at various locations to monitor current traffic speeds at those locations. Often, the monitoring systems also include video cameras at different locations to provide continuous images and live feeds of conditions.

FIG. 1 shows a prior art traffic information system, generally designated by reference numeral 10, for monitoring traffic on a public highway system. Systems such as this have been implemented by several states and other governmental agencies.

The information system of FIG. 1 includes a plurality of speed sensors or traps 12 at various locations along a public highway or along a network of public highways. The speed sensors might typically be spaced at intervals ranging from a tenth of a mile in highly congested areas to perhaps over a mile in less congested areas. Different sensors are positioned in different directions of travel.

The information system also includes a plurality of video cameras 14. The video cameras are positioned at chosen vantage points to allow highway personnel to view critical stretches of highway. The cameras do not necessarily have a one-to-one correlation with the speed sensors.

Signals from the sensors and cameras are routed to a central facility 16 for monitoring by highway personnel. The central facility typically includes one or more computers 18 for receiving speed sensor data and for displaying it in a meaningful way. For instance, the central facility might have a large wallmounted map with computer-controlled lights that flash to indicate highway locations where speeds are unusually low.

Camera video signals are routed to a video switch 20 within the central facility and distributed to one or more monitors 22. Typically, there are fewer monitors than available video signals, so the video switch is programmed to cycle through the signals in a predetermined sequence. Alternatively, the video switch might be controlled by one of computers 18. In this case, there might be some type of logic that determines which video signal is routed to a particular monitor. For example, the computer might be programmed to cycle through only those video signals that correspond to highway locations that are experiencing congestion.

The information system also includes a database 24 maintained by computers 18. The database is used to store historical data relating to highway conditions. In most cases, the database will not contain video, but instead will contain historical speed data.

Public highway monitoring systems are used by both highway personnel and news media. In addition, many systems are now being used to provide realtime traffic information to the public via the Internet. For example, traffic conditions can currently be accessed through the Internet for the following areas at the indicated Internet sites (designated by their uniform resource locators or URLS):

Houston "http://herman.tamu.edu/houston-real.html"

San Diego "http://www.scubed.com/caltrans/sd/bit_map.html"

Los Angeles "http://www.scubed.com/caltrans/la/la_transnet.html"

Manitoba: "http://umtig.mgmt.umanitoba.ca/default.htm"

Seattle: "http://www.ivhs.washington.edu/trafnet/"

To implement these sites, a server computer 26 is either located at the central facility 16 or connected for high-speed communications with the central facility. The server computer has a connection to the Internet.

The server computer is connected to access sensor data from the traffic information system. It uses the sensor data to create a continuously-updated map that indicates current traffic conditions.

While these Internet sites are useful, improvements are needed. One problem with the sites is that they display traffic information in different ways and require different user instructions to provide traffic information. While it would be desirable to create a common user interface that would access and display data from all of the available public highway monitoring systems, this is difficult because the data from the various systems is available only in different formats, depending on the particular proprietary format used by each monitoring system.

Another problem lies in the fact that information is presented in visual formats that are not immediately useful to users. For example, typical user interfaces for traffic monitoring systems show rough maps having roads that are divided into sections corresponding to locations of speed sensors. The sections are color-coded to indicate current speeds measured by corresponding sensors. For example, red might indicate "stop-and-go" conditions, yellow might indicate "slow" conditions, and green might indicate "normal" conditions. Icons might be used to indicate traffic incidents such as construction zones and crashes. While such user interfaces indeed present the available information, they do not do so in a way that is particularly useful to a person planning a commute across town.

SUMMARY OF THE INVENTION

The invention includes features that make traffic data more useful and accessible to travelers and specifically to commuters. A traffic information system in accordance with the invention has a user interface that includes an interactive road map. The road map is a stylized representation of a given coverage area, with major highways broken into high-level segments such as segments between major highway intersections. A user can interactively select any particular segment. In response, the user interface displays either the average speed for that segment or the time required to traverse that segment in light of the current average speed. The user can zoom in on a particular segment, resulting in a detail map showing a road segment broken into sub-segments. Each sub-segment is a major highway span such as one between two significant highway interchanges.

The traffic information system also acquires and displays still images of whatever segment or sub-segment is currently highlighted. The still images are acquired from video cameras located at vantage points above or adjacent highways.

The invention allows the user to personalize the parameters of the system to his or her specific household preferences by implementing a trip planner. The trip planner allows a user to designate beginning and ending locations and in response determines the best route and alternate routes from the beginning location to the ending location. To accomplish this, the trip planner evaluates all possible routes between two locations and identifies the one having the shortest travel time based on current average speeds for the sub-segments covered by the routes.

The invention further includes facilities for converting raw data and media feeds obtained from an existing public highway monitoring system into standard file formats used for internet enhanced personal computers and for interactive set-top boxes so that a single user interface can utilize data from many different highway monitoring systems.

DETAILED DESCRIPTION

Figure 1:
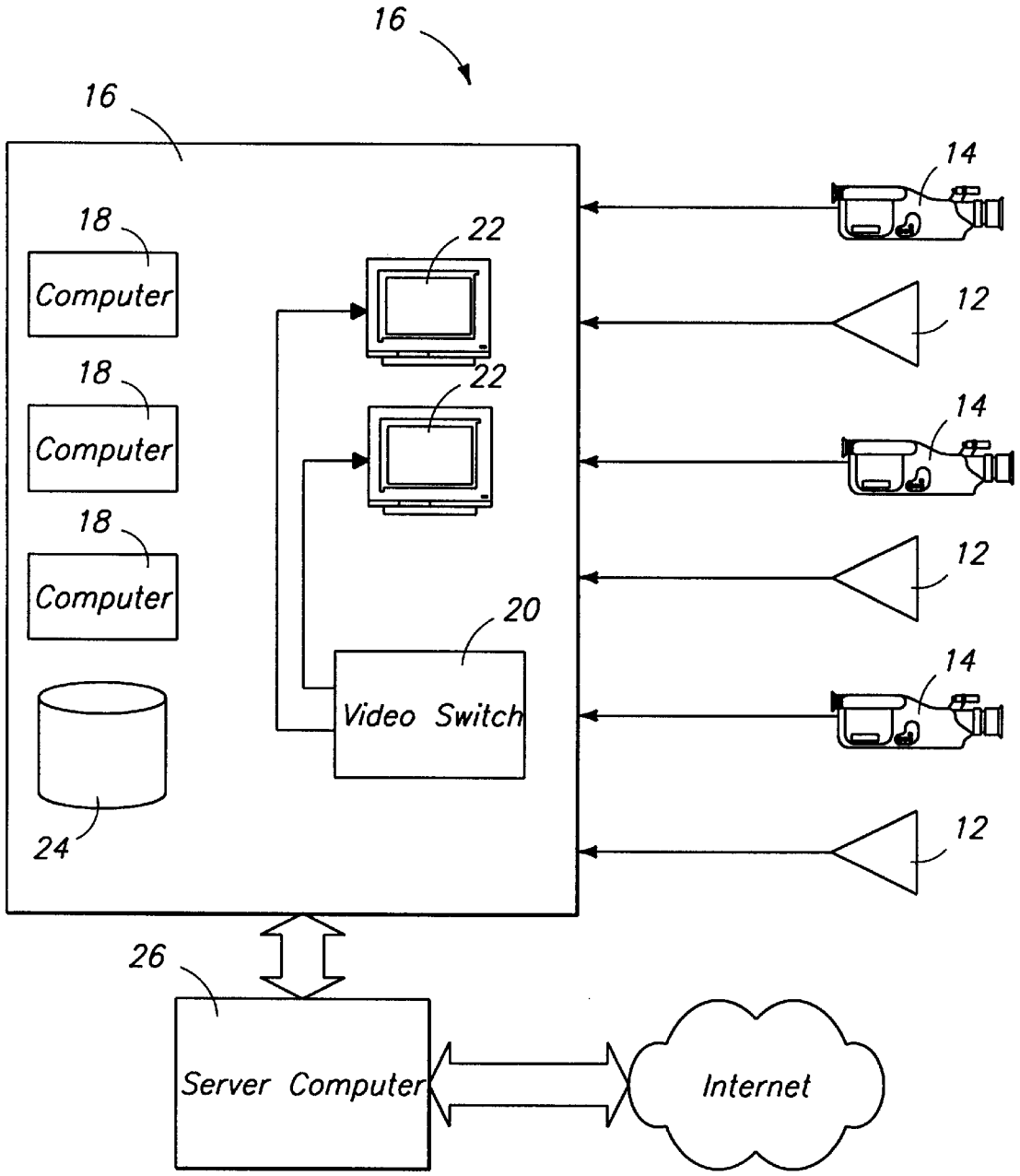
FIG. 1 is a block diagram of a prior art public highway monitoring system.
Figure 2:
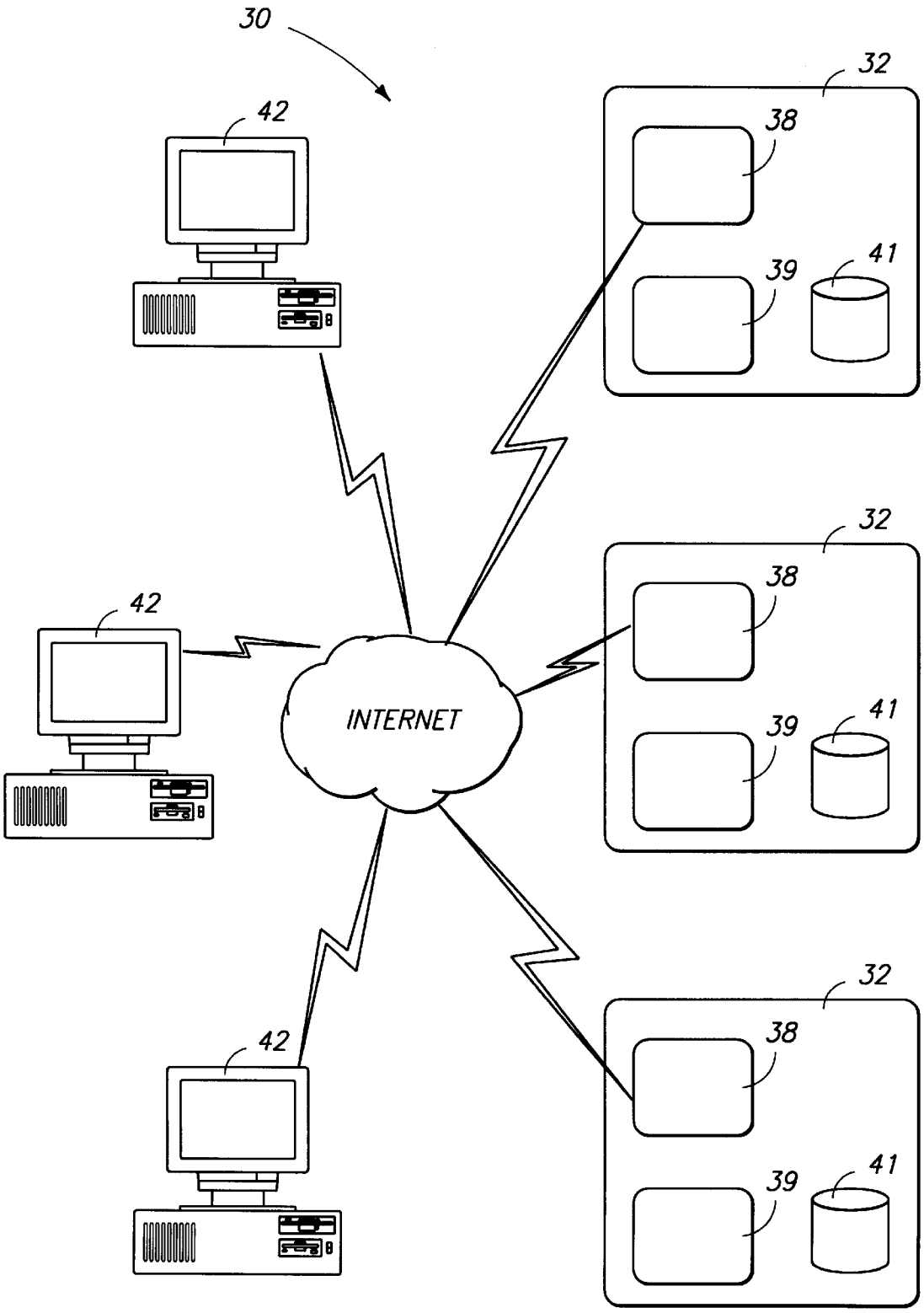
FIG. 2 is a block diagram of a traffic information system in accordance with one embodiment of the invention.

FIG. 2 shows a traffic information system in accordance with one embodiment of the invention, generally designated by reference numeral 30. Traffic information system 30 utilizes or includes a plurality of public highway monitoring systems 32 such as system 10 described above with reference to FIG. 1. Each monitoring system includes a plurality of sensors (shown in FIG. 1) indicating speeds on sub-segments of public roads, and a plurality of cameras (also shown in FIG. 1) focused on the road sub-segments, providing video images of said road sub-segments.

The traffic information system further includes a server computer 38 in each monitoring system 32. Server computer 38 is connected and programmed to obtain traffic data and road images from the public highway monitoring system in the format that is used by the monitoring system, to convert it into a pre-defined common format that is independent of the format of the highway monitoring system, and to provide it to requesting client devices in the common format on demand or in broadcast data form.

Server computer 38 can be one of the computers of the public highway monitoring system shown in FIG. 1. However, it is more likely that additional computers and servers will be used as intermediaries between the highway monitoring system and the client devices. For example, the server computer might be an Internet server. Alternatively, it might be part of a headend for a cable television network that implements some form of interactive services to subscribers. In some cases, the functions of server 38 might be performed by more than one computer. In other cases, a single computer might be used as a server for a plurality of highway monitoring systems. The server computers might be located at the central facilities of highway monitoring systems or at other, remote locations.

To provide images to server computer 38, a video server 39 is used within or in conjunction with each monitoring system 32. The video server maintains connections with the video cameras and captures still images or short video clips from the cameras' video feeds at periodic intervals. The still images are stored in bitmap, JPEG, MPEG, or other conventional formats and provided to server computer 38 as requested.

Figure 3:
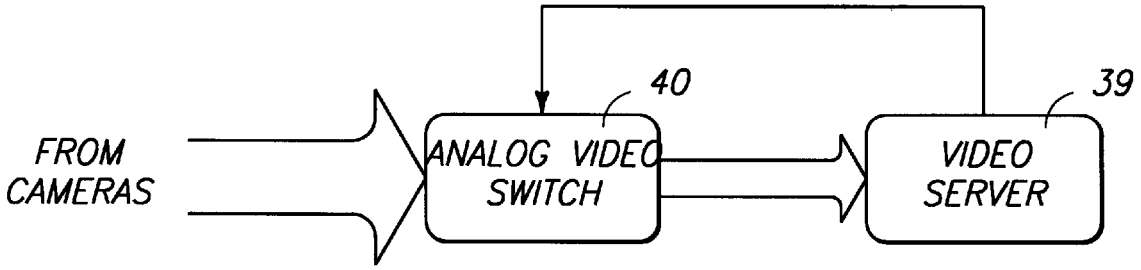
FIG. 3 shows how a video server acquires still images from a plurality of video cameras used in a public highway monitoring system.

FIG. 3 shows how a video server might be connected to acquire data and still images from the highway monitoring system. FIG. 3 shows a video server 39 connected to control an analog video switch 40. Switch 40 receives video signals from the cameras of the highway monitoring system, and produces a single output to video server 39 with a signal from a selected camera as commanded by server 39. Video server 39 has a digitizing card that grabs still images or short motion video clips from the supplied video signal at appropriate times. Video server 39 stores the images as bitmaps, JPEG, or MPEG files.

Upon receiving a static image in the form of a bitmap, server computer 38 adds a time-stamp in the lower area of the image and compresses the image. Other optional formatting, assembly and image enhancement can be performed at this point if desired. In some systems, the highway monitoring system will have already stamped the image with information identifying the camera from which the still image was acquired. A short motion video clip can be substituted for a still image if the appropriate transmission bandwidth is available.

Server computer 38 maintains a dynamic library 41 (FIG. 2) of acquired images stored as data files. It uses a reverse alphabetical naming convention for the files. The first file ever generated is ZZZZZZZZ.i (where  is replaced by a number representing the camera from which an image was taken) and subsequent files are named using the alphabetically closest but preceding name in all upper-case letters. Thus, the second file would be ZZZZZZZY.i, the twenty-seventh file would be ZZZZZZYZ.i, and so on. This naming convention can be extended by adding more characters to the naming system, such as lower-case characters. However, the convention described will accommodate $2.1*10^{11}$ images, thereby accommodating one acquired image every 1.5 minutes for 610,000 years.

After acquiring each image, the server computer determines how many converted files currently exist within library 41. If the number of images has reached a specified limit, the oldest image is eliminated, and the newly-acquired image is stored. This allows external devices to access a significant historical record of transportation conditions.

Traffic information system 30 further includes a plurality of client devices 42 configured to receive sensor data and static camera images from the server computers. Preferably, the requesting client devices receive data in a data format that is independent of the particular format used within the central facilities of the public highway monitoring systems.

Client devices 42 might comprise a number of different types of devices, each having some form of associated display device and graphical display surface. A CRT is an example of such a display device. A flat-panel LCD is another example.

In the embodiment shown, client devices 42 comprise personal or desktop computers having data processors configured and connected to communicate with server computer 38 through the Internet and to receive current traffic data and images. Each such client device has one or more forms of computer-readable storage media, including both volatile and non-volatile memory. For example, the client devices shown in FIG. 2 have hard disks for storing application programs. The client devices also have internal electronic memory into which application programs are loaded for execution.

A client device 42 might also be a so-called "network computer" —a limited-capability computer designed specifically for navigation on the World Wide Web of the Internet. Alternatively, client devices 42 might be set-top boxes or intelligent televisions connected to receive data through an entertainment medium such as a cable television network or a digital satellite broadcast.

In the embodiment shown, the client devices run conventional Internet "browsers" such as Microsoft's Internet Explorer™. Such browsers download and render multimedia content that is formatted in "hypertext markup language" (HTML) or rendered by small, downloadable applications called Applets. In this environment, server computers 38 might be programmed to implement the most significant portions of a user interface. Specifically, most of the intelligence for implementing the user interface would be resident in server computers 38: the client devices would use their browsers to simply display downloaded content and to relay user inputs back to the server computers. The server computers would respond by formatting new screen displays and downloading them for display on the client computer.

In other embodiments, server computers 38 might be used primarily as sources of data, with primary responsibility for a user interface being placed upon the client computers. In other words, a client computer would run an application program implementing a desired user interface, and would retrieve raw images and data from a server computer as required. The servers would provide the data in a common format which will be described below.

With newer technology such as Active™ controls, a combination of these approaches is conceivable. Client devices could use Internet browsers, with a sophisticated user interface being implemented as one or more intelligent ActiveX™ controls. The controls could be configured to download raw data and image s rather than full HTM documents. Thus, the intelligence behind the user interface could be distributed between the servers and the clients in different ways.

FIGS. 4 through 8 illustrate a preferred user interface in accordance with the invention, generally indicated by reference numeral 60. As mentioned, the user interface can be implemented using various technologies and different devices, depending on the preferences of the designer and the particular efficiencies desired for a given situation.

User interface 60 includes a road map in an interactive, graphical format. The road map is designated by reference numeral 62 in FIG. 4. In this example, it is a stylized representation of freeways in the Seattle, Washington, area. The entire coverage area is broken up into high-level regions, referred t o as segments, which represent major highway segments—such as segments between major highway intersections. These segments are further broken into sub-segments of lengths that retain some realistic meaning to a user. For instance, a sub-segment might be a highway span between two well-used exits. There may or may not be a one-to-one relationship between monitoring sensor s and highway sub-segments: the sub-segments are defined based upon factors that have meaning to users, rather than on the arbitrary placement of sensors. Each sub-segment might span a plurality of sensors and have a plurality of cameras.

Figure 4:
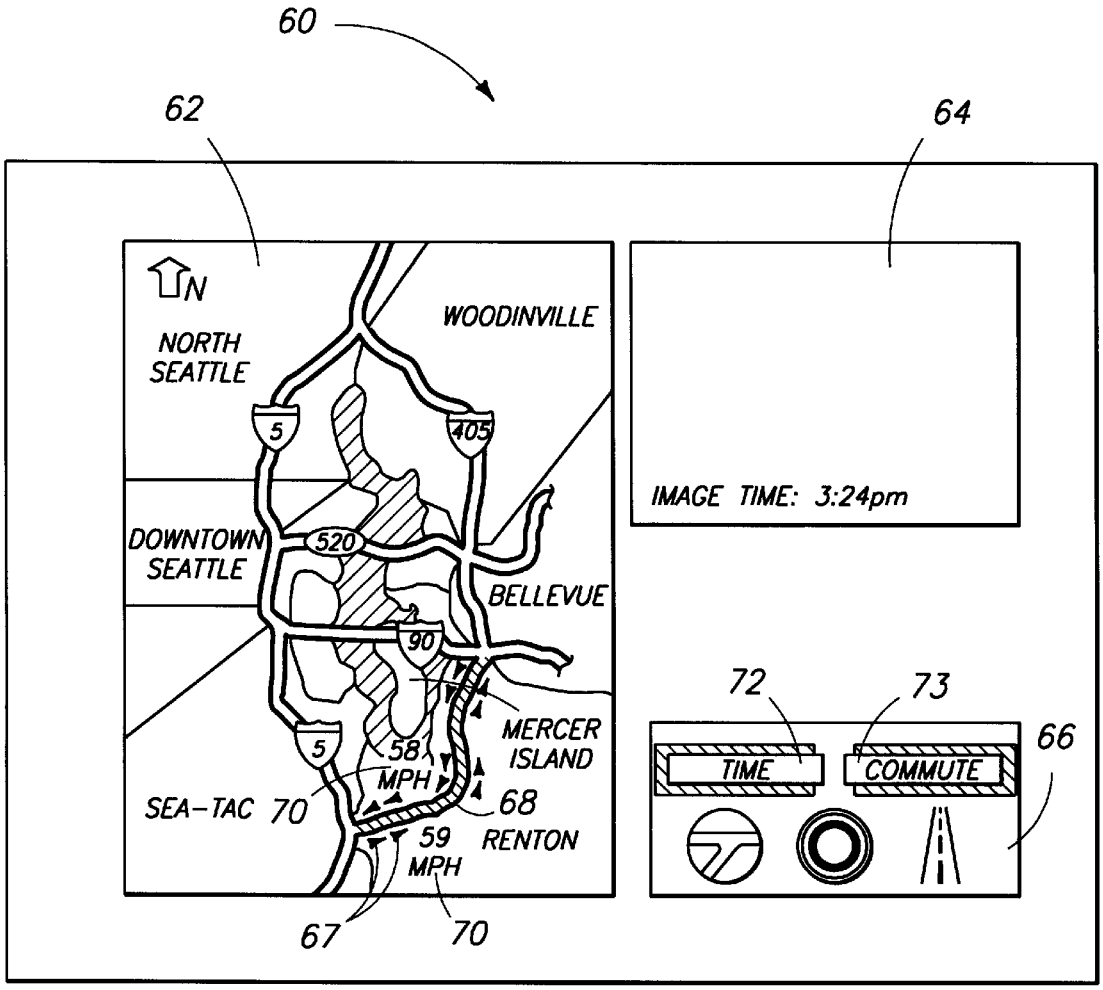
FIGS. 4–8 shows examples of a user interface in accordance with the invention.

FIG. 4 shows road map 62 in broad view, in which road segments are identifiable. A user can interactively select particular road segments by moving an on-screen cursor or other type of on-screen indicator. Towns or residential areas are identified on the road map, as are highway numbers and prominent geographic features. The road map is located at the left side of the user interface.

A road image area 64 occupies the upper right portion of the user interface. The road image area changes as the user highlights or selects different road segments, to show recent still images or short video clips of any currently selected road segment. The images are obtained from server computer 38. Generally, the images come from cameras that coincide with sub-segments of the particular segment that the user has selected.

A command area 66 occupies the lower right portion of the screen. The command area has icons that can be selected to carry out various commands as will be described in more detail below. The command area also has room for logos or other advertising materials.

Referring again to road map 62, individual road segments are highlighted by moving cursor control keys on a keyboard or infrared remote control device, or by manipulating a mouse. The currently selected road segment is indicated by a series of adjacent arrows or arrow heads 67. The arrows are positioned on both sides of the segments to indicate direction of traffic. In FIG. 4, a road segment through Renton, identified by reference numeral 68, is highlighted.

A traffic description is depicted on the user interface when a particular road segment is highlighted or selected. The traffic description is relevant to the selected road segment, and is positioned adjacent the road segment when the road segment is highlighted. In FIG. 4, the traffic description, indicated by reference numeral 70, indicates the current average speed for the selected road segment in both directions of travel. By selecting or activating the "time" icon in the command area, indicated by reference numeral 72, a user can instruct the user interface to display the current travel time for the selected road segment. The travel time is the time, displayed in minutes and seconds, required to traverse the road segment, based on the length of the segment and the current average speed. Speeds and travel times are shown for both directions of travel for any selected road segment.

Figure 5:
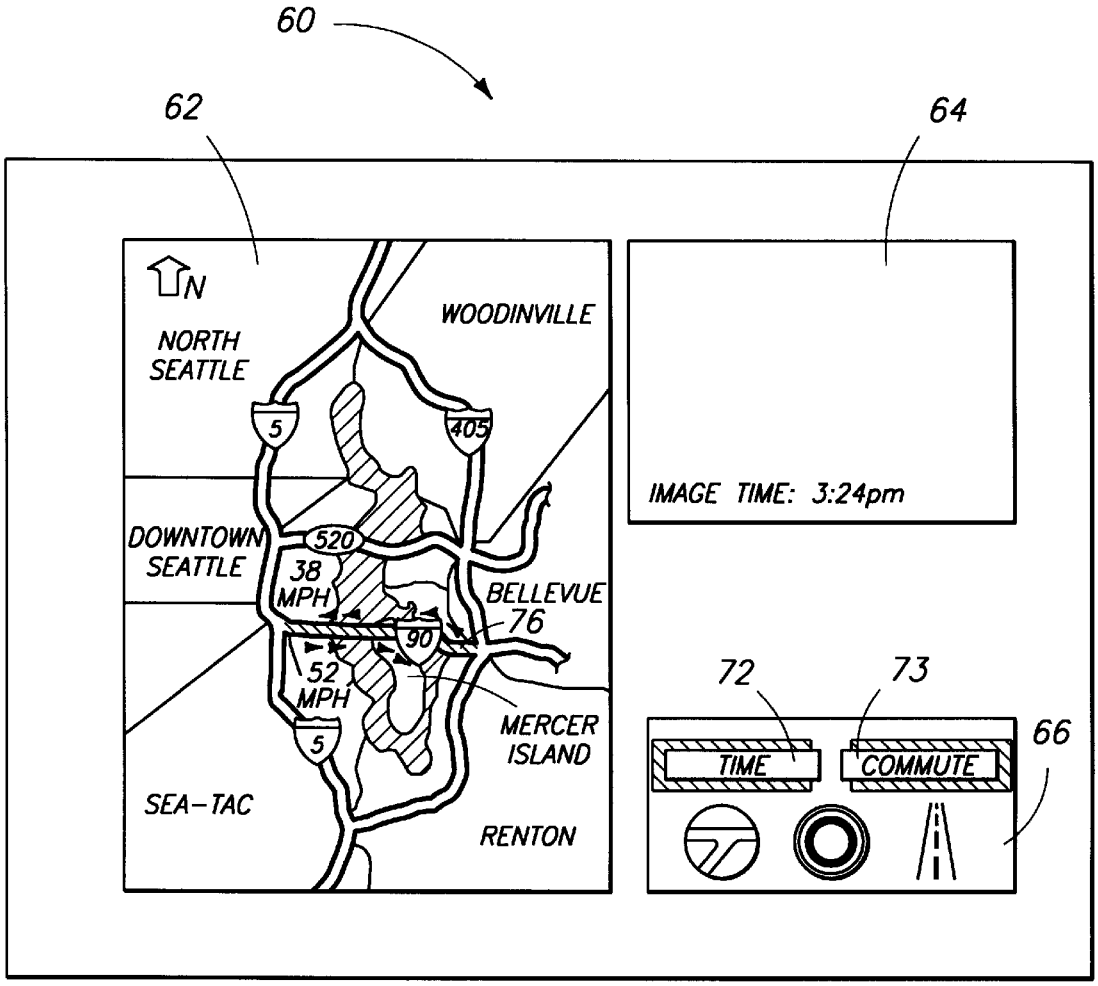
Figure 6:
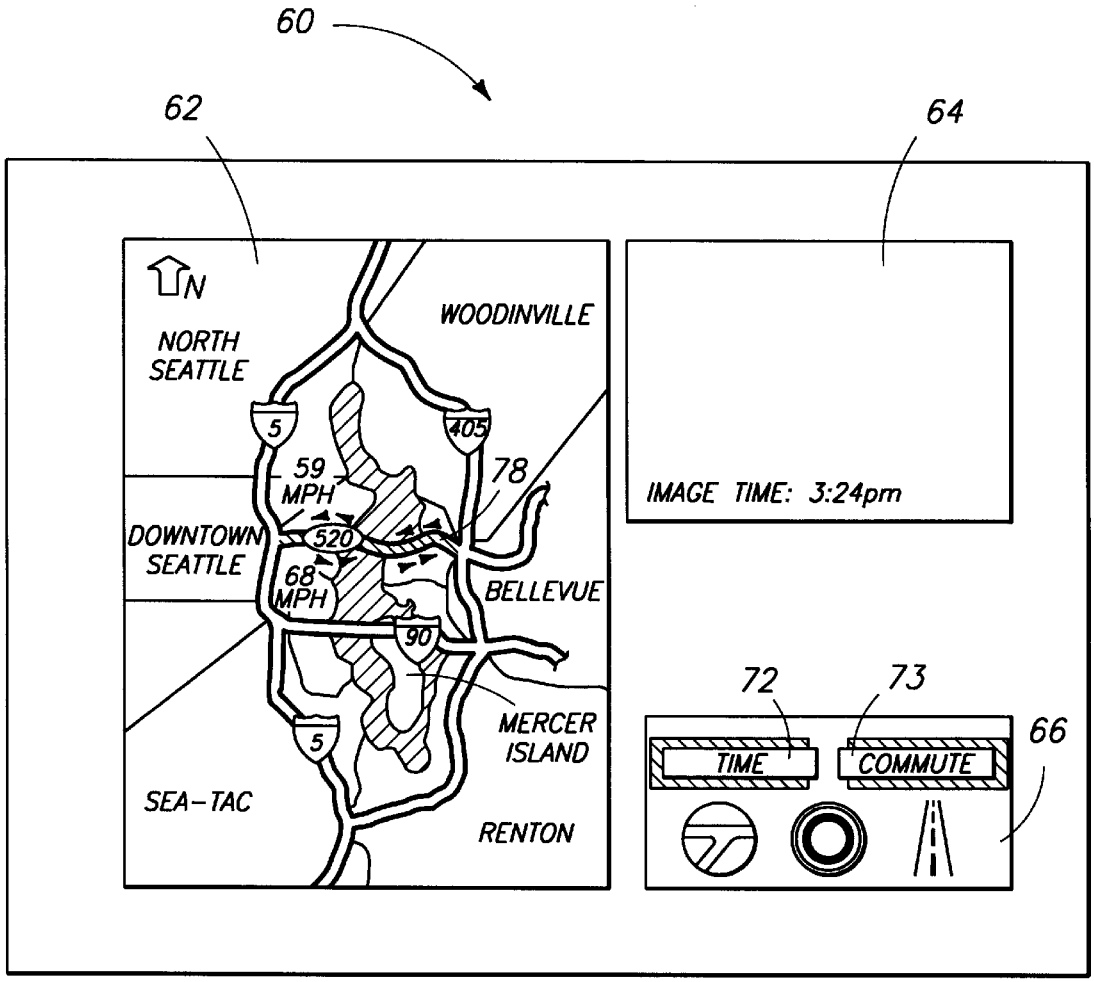

FIG. 5 shows the effect of pressing an "up" key or of moving a cursor upward and selecting road segment 76. The highlighting arrows move upwardly to be positioned adjacent segment 76. The traffic descriptions change to show the current speed or travel time for the new road segment, and the image in road image area 64 changes to show a still image from the currently selected road segment. Pressing an "up" key again highlights road segment 78, as shown in FIG. 6, with similar changes in the traffic description and road image area.

In general, each road segment represented on map 62 contains a plurality of sensors and a plurality of cameras. Readings from the sensors are averaged to derive an average speed for the overall road segment. When a particular road segment remains selected, camera images are cycled at a rate of about once every ten seconds, to show different recent images of the road segment, taken from different vantage points. Optionally, the user interface might include a way for the user to request historical images. The user interface in this case responds by cycling historical images of the selected road segment in the road image area at defined intervals.

Figure 7:
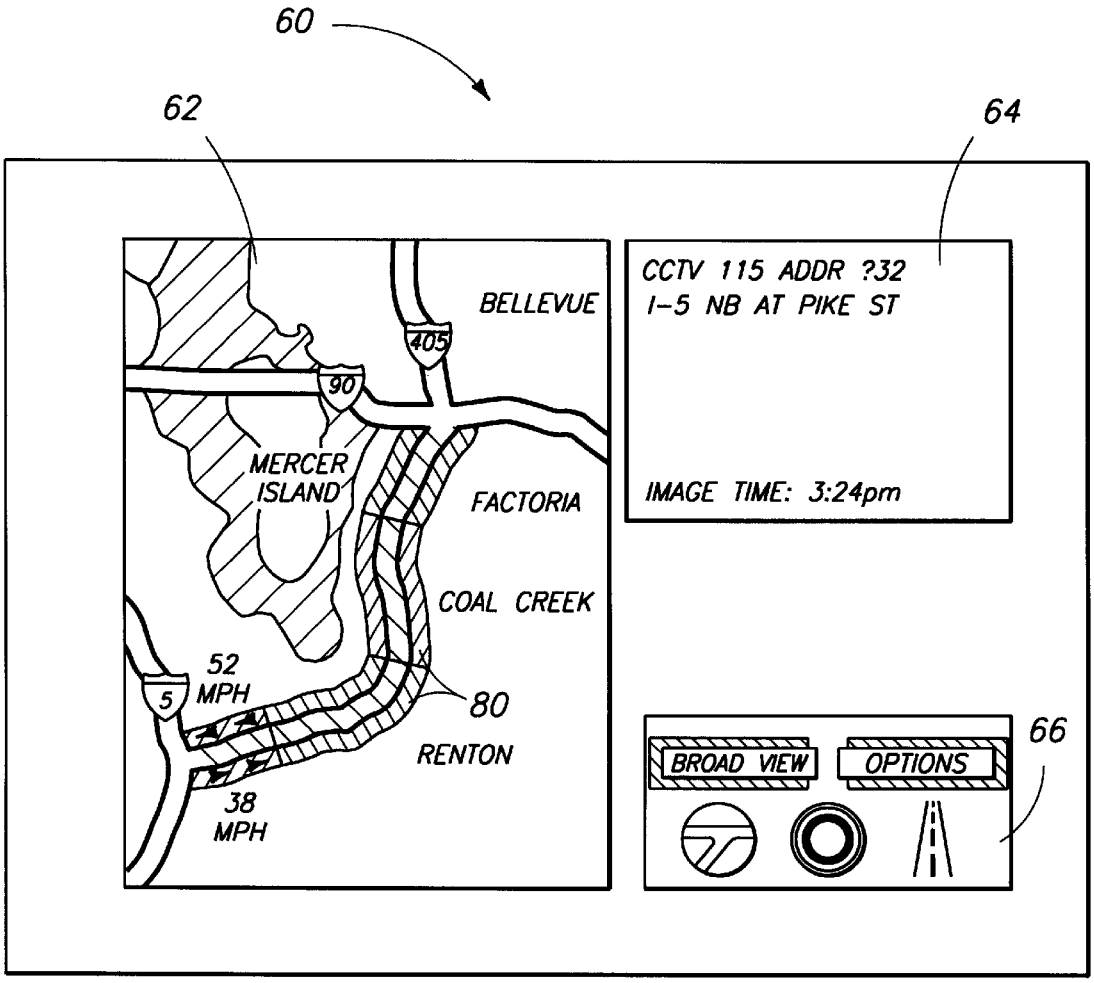
Figure 8:
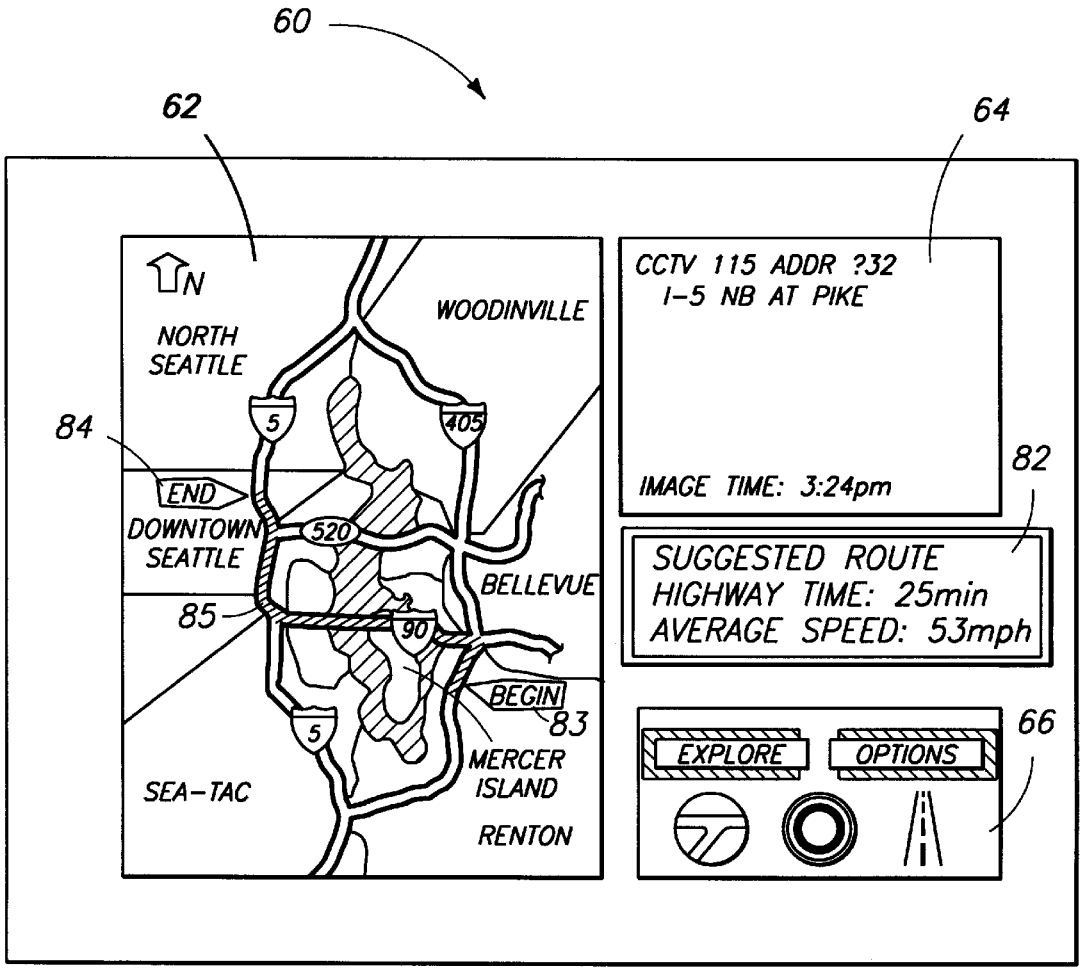

FIG. 7 shows a detail map that "zooms in" on a selected road segment. The user can select this view by highlighting the road segment and then pressing an "action" or similar key. In a Microsoft Windows® environment, the segment might be selected by double-clicking. A detail map corresponds to a particular road segment and breaks that segment into its sub-segments, designated by reference numeral 80 in FIG. 7. The user can select individual sub-segments, in a manner identical to that already described with reference to FIGS. 4–6. The road image area changes as different sub-segments are selected so that a still image from the currently selected sub-segment is always shown. If more than one camera has coverage of the selected sub-segment, still images are cycled through each available camera view. A progression feature is optionally implemented in this view: after a certain sub-segment has been highlighted for a pre-determined time, the highlight will automatically progress to another sub-segment.

The traffic information system also includes a trip planner implemented within the user interface. A trip planning mode can be initiated by selecting an on-screen "commute" button 73. In response, the user is prompted for a starting location and a destination location on the displayed road map 62. The starting and destination locations are specified by highlighting the desired points with directional keys and/or mouse movement. The trip planner is configured to store two sets of starting and destination locations, so that a user can specify and store two different commutes. In the preferred embodiment, the selections are made from detail maps such as the one shown in FIG. 7. This allows the user to specify the starting and destination locations in terms of sub-segments, thereby allowing the commutes to be tailored more carefully to the actual trip routes used by individual users.

In response to specifying starting and destination locations in the trip planning mode, the user interface calculates or derives a shortest-time route from the starting location to the destination location based on current sensor data from the highway monitoring system sensors. It examines all possible routes, and plots or highlights the shortest-time route on road map 62 as shown by the highlighted portion 85 in FIG. 8. A dialog box 82 also appears, showing the estimated travel time and average speed based on current conditions. The selected starting and destination locations are indicated by labels 83 and 84, respectively. The user can select either of the two stored commutes when initiating the trip planning mode.

The shortest route for the selected commute is determined by summing the travel times for all the segments or sub-segments of the routes. Optionally, the trip planner allows the user to also show less preferred routes, such as the second shortest route, the third shortest route, and so on.

As another optional feature, the user interface is configured to automatically show trip preview images. Specifically, images taken from segments and/or sub segments of the preferred route are chosen and shown in sequence in road image area 64.

As mentioned above, the server computers supply traffic data and images in a common format that is independent of the particular formats used within the various monitoring systems. In the embodiment described above, the information is supplied in HTML format. However, embodiments in which the client devices assume more responsibility for the user interface might provide the information to the clients in a more basic format or as an applet.

Figure 9:
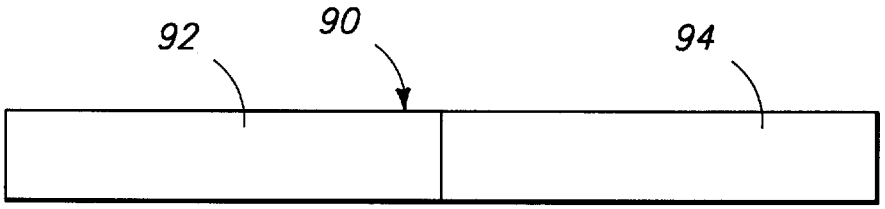
FIG. 9 illustrates a common data format for providing traffic data.

FIG. 9 illustrates a format that is advantageous in environments where traffic data is supplied from a server without graphical formatting. In general, the data includes a first series of values in a known order, indicating speeds for sub-regions of a public highway system, followed by a second series of values in a known order indicating locations of traffic incidents in said sub-regions.

More specifically, the format comprises a binary data file 90 having two portions, each consisting of a series of one byte (eight bit) values. A first portion 92 has a series of bytes, each of which has a value representing a speed measured at a particular highway sensor. The values are in a known, pre-determined order. They are arranged in pairs, with each pair having values corresponding to the two different directions of a single sub-segment, with each sub-segment corresponding to a single pair of sensors.

A second portion 94 is used for describing "incidents" such as crashes or other highway disruptions. The first byte of this portion indicates how many incidents are reported in the following bytes. Following this are two-byte pairs, with the first byte of each pair indicating the sub-segment of an incident and the second byte indicating wherein along the sub-segment the incident is located. This second value indicates a proportional location from north to south or east to west along the sub-segment at which the incident occurred.

While the invention has been described above primarily in terms of its exemplary components, the invention also includes the methodological steps implemented by the components. The invention is also claimed in terms of computer-readable storage media containing computer-executable instructions for performing such methodological steps. Such computer-readable storage media includes various forms of removable magnetic and optical media, such as floppy disks, optical disks, and other similar media, as well as volatile program storage memory such as hard disks and electronic RAM and ROM within a computer. Furthermore, the invention is claimed below in terms of a programmable computer, data processor, or other device configured and/or programmed for performing the methodological steps described herein:

Methodological steps for providing traffic information to client devices include a step of obtaining traffic data and road images from a public highway monitoring system in a format that is particular (and possibly proprietary) to the public highway monitoring system. A further step includes converting the traffic data and road images into common file formats in a near real time process such as described above, regardless of the formats used by the public highway monitoring system. The invention further includes providing the traffic data, road images and video in the common format to requesting client devices. These steps are advantageously performed by one or more computers that act as data servers or Internet servers.

The invention further includes methodological steps for presenting traffic information in the form an interactive user interface. Such steps include obtaining current traffic data from a plurality of road sub-segments. The traffic data includes travel speeds for the sub-segments. The steps further include displaying a road map to a user in a graphical format. The road map shows a plurality of road segments, each of which comprises a plurality of the road sub-segments. Another step comprises allowing a user to individually select road segments on the road map. In response, the user interface performs steps of deriving and displaying a travel time for the selected road segment. The derivation of the travel times is based upon the travel speeds of the selected road's sub-segments.

Further steps include obtaining a recent image of the selected road segment and displaying it along with the road map. The user interface cycles different recent images of the selected road segment when the segment remains selected for a pre-determined time. Optionally, or at the user's specific command, the user interface cycles historical images of the selected road segment at defined intervals.

The user interface uses further steps to display more traffic and commuter-specific details. Such steps include showing a detail map of a particular selected road segment in response to a command from the user, wherein the detail map includes the selected road segment's sub-segments. These steps also include allowing a user to individually select road sub-segments on the detail map, and displaying recent images of the currently selected road sub-segments alongside the detail map.

The invention also includes a method of identifying a preferred route on a public highway system. This method includes a step of obtaining current traffic data in terms of travel speeds on sub-segments of the public highway system, and deriving current travel times for the sub-segments from the travel speeds. Further steps include displaying the travel times in conjunction with a road map. Such steps also include accepting a starting location and a destination location from a user and in response identifying a shortest-time route from the starting location to the ending location based on the derived current travel times of the road sub-segments.

The invention provides a needed improvement by making it possible for users to access information in a format that is chosen for their particular needs, specifically standard PC file formats.

In compliance with the statute, the invention has been described in language more or less specific as to structural and methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A user interface for depiction on a graphical display surface, comprising:

an interactive road map displayed on the graphical display surface, the interactive road map showing a plurality of road segments that are interactively selectable by a user on the graphical display surface;

a road image area displayed on the graphical display surface alongside the interactive road map, wherein the road image area changes as the user selects different road segments to show recent images of a currently selected road segment.

2. A user interface as recited in claim 1, wherein the recent images shown in the road image area are recent video clips of the currently selected road segment.

3. A computer and associated display device, the computer being programmed to implement the user interface of claim 1.

4. A computer-readable medium having computer-executable instructions for implementing the user interface of claim 1 in conjunction with a display device having a graphical display surface.

5. A user interface as recited in claim 1, wherein the recent images are still images.

6. A user interface as recited in claim 1, wherein different recent images of a particular road segment are cycled in the road image area when the particular road segment remains selected.

7. A user interface as recited in claim 1, the user interface being responsive to a command from the user to cycle historical images of the selected road segment in the road image area at defined intervals.

8. A user interface as recited in claim 1, the user interface accepting a starting location and a destination location from the user and in response indicating a shortest-time route from the starting location to the destination location based on current travel times of the road segments.

9. A user interface for depiction on a graphical display surface, comprising:

a road map showing a plurality of road segments that a user can interactively select;

a road image area that changes as the user selects different road segments to show recent images of a currently selected road segment;

the user interface being responsive to a command from the user to show a detail map of a particular selected road segment, wherein the detail map includes road sub-segments of the particular road segment that the user can interactively select;

wherein the road image area shows recent images of a currently selected road sub-segment.

10. A user interface as recited in claim 1, further comprising a traffic description relevant to a particular road segment, the traffic description being depicted on the graphical display surface when said particular road segment is selected by the user.

11. A user interface as recited in claim 10, wherein the traffic description includes the current average speed for the particular road segment.

12. A user interface as recited in claim 10, wherein the traffic description includes the current travel time for the particular road segment.

13. A user interface as recited in claim 10, wherein the traffic description can be designated by the user to include at least one of the current travel time and the current average speed for the particular road segment.

14. A computer-readable medium having computer-executable instructions for performing steps comprising:

obtaining current traffic data for a plurality of road segments;

displaying an interactive road map to a user on a graphical display surface, the interactive road map showing the plurality of road segments that are interactively selectable by a user on the graphical display surface;

allowing a user to individually select road segments on the interactive road map by interactively selecting road segments on the graphical display surface;

displaying recent images of the currently selected road segment alongside the interactive road map on the graphical display surface.

15. A computer-readable medium as recited in claim 14 wherein the recent images are recent video clips of the currently selected road segment.

16. A computer-readable medium as recited in claim 14 wherein the recent images are recent video clips of the currently selected road segment, the computer-readable medium having further instructions for performing an additional step of cycling historical video clips of the selected road segment at defined intervals in response to a user's request.

17. A computer-readable medium as recited in claim 14 having further instructions for performing an additional step of cycling different recent images of a particular road segment when the particular road segment remains selected.

18. A computer-readable medium as recited in claim 14 having further instructions for performing an additional step of cycling historical images of the selected road segment at defined intervals in response to a user's request.

19. A computer-readable medium having computer-executable instructions for performing steps comprising:

obtaining current traffic data for a plurality of road segments;

displaying a road map to a users, the road map showing the plurality of road segments;

allowing a user to individually select road segments on the road map;

displaying recent images of the currently selected road segment alongside the road map;

showing a detail map of a particular selected road segment in response to a command from the user, wherein the detail map includes road sub-segments of the particular road segment;

allowing a user to select a starting road sub-segment on the detail map;

allowing a user to select a destination road sub-segment on the detail map;

deriving current travel times of the road segments based on the current travel speeds;

indicating a shortest-time route from the starting road sub-segment to the destination road sub-segment based on the current travel times of the road segments.

20. A computer-readable medium having computer-executable instructions for performing steps comprising:

obtaining current traffic data for a plurality of road segments;

displaying a road map to a user, the road map showing the plurality of road segments;

allowing a user to individually select road segments on the road map;

displaying recent images of the currently selected road segment alongside the road map;

showing a detail map of a particular selected road segment in response to a command from the user, wherein the detail map includes road sub-segments of the particular road segment;

allowing a user to individually select road sub-segments on the detail map;

displaying recent images of the currently selected road sub-segment alongside the detail map.

21. A computer-readable medium as recited in claim 14 having further instructions for performing an additional step of displaying a traffic description relevant to a particular road segment when said particular road segment is selected by the user.

22. A computer-readable medium as recited in claim 21 having further instructions for performing an additional step of deriving the current average speed for the particular road segment from the traffic data, the traffic description indicating said current average speed.

23. A computer-readable medium as recited in claim 21 having further instructions for performing an additional step of deriving the current travel time for the particular road segment from the traffic data, the traffic description indicating said current travel time.

24. A method of presenting traffic information comprising the following steps:

obtaining current traffic data for a plurality of road sub-segments, the traffic data including travel speeds for the road sub-segments;

displaying an interactive road map to a user on a graphical display surface, the road map showing a plurality of road segments, each road segment comprising a plurality of the road sub-segments that are interactively selectable by is a user on the graphical display surface;

allowing a user to individually select road segments on the interactive road map by interactively selecting road segments on the graphical display surface;

deriving a travel time for a selected road segment from the travel speeds of the road segment's sub-segments;

displaying the travel time for the selected road segment;

obtaining a recent image of the selected road segment;

displaying the recent image alongside the interactive road map on the graphical display surface.

25. A computer-readable medium having computer-executable instructions for performing the steps of claim 24.

26. A programmable device that is programmed for performing the steps of claim 25.

27. A method as recited in claim 24, comprising an additional step of cycling different recent images of the selected road segment when the selected road segment remains selected.

28. A method as recited in claim 24, comprising an additional step of cycling historical images of the selected road segment at defined intervals.

29. A method of presenting traffic information comprising the following steps:

obtaining current traffic data for a plurality of road sub-segments, the traffic data including travel speeds for the road sub-segments;

displaying a road map to a user, the road map showing a plurality of road segments, each road segment comprising a plurality of the road sub-segments;

allowing a user to individually select road segments on the road map;

deriving a travel time for a selected road segment from the travel speeds of the road segment's sub-segments;

displaying the travel time for the selected road segment;

obtaining a recent image of the selected road segment;

displaying the recent image alongside the road map;

showing a detail map of a particular selected road segment in response to a command from the user, wherein the detail map includes the selected road segment's sub-segments;

allowing a user to individually select road sub-segments on the detail map;

displaying recent images of the currently selected road sub-segments alongside the detail map.

30. A method of presenting traffic information comprising the following steps:

obtaining current traffic data for a plurality of road sub-segments, the traffic data including travel speeds for the road sub-segments;

displaying a road map to a user, the road map showing a plurality of road segments, each road segment comprising a plurality of the road sub-segments;

allowing a user to individually select road segments on the road map;

deriving a travel time for a selected road segment from the travel speeds of the road segment's sub-segments;

displaying the travel time for the selected road segment;

obtaining a recent image of the selected road segment;

displaying the recent image alongside the road map;

showing a detail map of a particular selected road segment in response to a command from the user, wherein the detail map includes the selected road segment's sub-segments;

allowing a user to select a starting road sub-segment on the detail map;

allowing a user to select a destination road sub-segment on the detail map;

deriving current travel times of the road segments based on the current travel speeds;

indicating a shortest-time route from the starting road sub-segment to the destination road sub-segment based on the current travel times of the road segments.

31. A method as recited in claim 24, comprising an additional step of displaying a traffic description relevant to a particular road segment when said particular road segment is selected by the user, the traffic description including the current travel time for the particular road segment.

32. A traffic information system comprising:

a plurality of sensors indicating speeds on sub-segments of public roads;

a plurality of cameras focused on said road sub-segments;

a server computer connected and programmed to gather data from the sensors and images from the cameras;

a plurality of client devices configured to receive sensor data and camera images from the server computer;

a display device associated with each client device;

each client device being programmed to display an interactive road map to a user on the display device, the interactive road map showing a plurality of road segments, each road segment comprising a plurality of road sub-segments that are interactively selectable by a user on the display device;

the client device being further programmed to display recent images of the road segments from the cameras alongside the interactive road map on the display device in response to a user selecting such road segments.

33. A traffic information system as recited in claim 32, wherein the cameras provide video images of said road sub-segments, the server computer being configured to acquire still images at periodic intervals to provide to the client devices on demand.

34. A traffic information system as recited in claim 32, wherein the cameras provide video images of said road sub-segments, the server computer being configured to acquire video clips at periodic intervals to provide to the client devices on demand.

* * * * *